US005322081A

United States Patent [19]

Isaac

[11] Patent Number: 5,322,081

[45] Date of Patent: Jun. 21, 1994

[54] PAINT ROLLER CLEANER

[76] Inventor: Raphael Isaac, 37 Mulligan La., Irvington, N.Y. 10533

[21] Appl. No.: 21,759

[22] Filed: Feb. 24, 1993

[51] Int. Cl.[5] ..... B08B 3/04

[52] U.S. Cl. ..... 134/182; 134/166 R; 134/168 R; 134/900

[58] Field of Search ..... 134/182, 183, 166 R, 134/168 R, 900

[56] References Cited

U.S. PATENT DOCUMENTS

| | | | |
|---|---|---|---|
| 2,819,483 | 1/1958 | Macaulay | 15/121.2 |
| 2,919,704 | 1/1960 | Butler | 134/166 R X |
| 3,566,892 | 3/1971 | Logue | 134/166 R X |
| 3,583,413 | 6/1971 | Mertzanis | 134/116 R |
| 3,642,013 | 2/1972 | Thierstein | 134/152 X |
| 4,172,373 | 10/1979 | Lary | 134/900 X |
| 4,380,478 | 4/1983 | Cooney | 134/900 X |
| 4,585,019 | 4/1986 | Jacobson | 134/152 X |
| 4,606,777 | 8/1986 | Brow | 134/38 |
| 4,765,354 | 8/1988 | Thatcher | 134/182 |
| 4,766,755 | 8/1988 | Allen | 68/213 |
| 4,811,749 | 3/1989 | Dixon | 134/184 |
| 4,957,127 | 9/1990 | Kostopoulos | 134/112 |
| 5,163,459 | 11/1992 | Bailey | 134/900 |

*Primary Examiner*—Frankie L. Stinson

[57] ABSTRACT

A paint roller cleaner, for water based paints, that is inserted through a specially designed paint roller and that is attachable to the standard garden hose with the purpose of cleaning the nap of the paint roller. The structure is made of a sixteen-inch plastic tube with one end closed and the other end with a hose attachment. The first nine inches from the closed side has eight rows of twenty-four one-sixteenth holes, evenly spaced, and a raised handle that keeps the paint roller in place. Structural means are provided for directing the water flow in such a manner that water sprays perpendicularly outward through the holes and through the nap with equal intensity from the top to bottom of the roller.

10 Claims, 3 Drawing Sheets

PAINT ROLLER CLEANER

FIELD OF INVENTION

The present invention relates generally to painting and particularly to paint rollers and paint roller cleaners.

An aspect of the invention is to clean a specially designed paint roller, in which the cleaner is inserted into the paint roller, thus cleaning the nap of the roller with water, from a garden hose or similar water dispenser, that sprays perpendicularly outward from the cleaner and thru the nap of the roller.

BACKGROUND OF INVENTION AND BRIEF DESCRIPTION OF PRIOR ART

For most people, including professionals and do-it-yourself property owners or property managers, cleaning up after painting can be quite a chore, especially if paint rollers were used.

Commonly, paint rollers include an inner tube and an outer nap secured to the inner tube by some adhesive. The nap of the roller is usually made of carpet like material, though there are many different materials available to provide a desired texture to the finished product, i.e. walls, ceilings. The usual paint applicator includes a revolvable cylinder that is inserted into the inner tube of the roller and a handle. There are several procedures available to clean a paint roller after it has been used. One is to remove the paint roller from the applicator and put it into a bucket of water and swish the roller around until it is clean or as close to clean as possible. The more common approach is to hose the roller off. This however, is time consuming and often very messy. Moreover, it is hard to do because while spraying one side of the roller the paint gets pushed around to the other side and then back again, and so on. That is the problem with cleaning a roller from the outside, unlike this invention which cleans the roller from the inside out.

Given the difficulties, many roller users simply throw away the roller and purchase a new one. Depending on the size and nature of the job, this approach can be very costly.

While closable storage devices are known, i.e. those suitable for storing a wet roller for a period of time against immediate dry-out by air, no devices are known, nor is there acquaintance with any patent literature, teaching a method and structure for cleaning specially designed paint rollers by using an inserted structure that sprays water perpendicularly outward through the nap of the roller to be cleaned.

BRIEF DESCRIPTION OF PRESENT INVENTION

One aspect of the invention is in the provision that the paint roller cleaner is inserted through the specially designed paint roller and that the cleaner is attachable to the standard garden hose with the purpose of cleaning the nap of the paint roller. The structure is made of a plastic tube with one end closed and the other end with a hose attachment. The first nine inches from the closed, or sealed, side has eight rows of twenty four one-sixteenth holes, evenly spaced, that allows the water to spray perpendicularly outward from the structure. To ensure proper and even water pressure throughout the structure, a tube one-half inch in diameter is placed inside the structure four and one-half inches from the sealed end and extending an additional four and one-half inches towards the hose connector. At the closest end towards the sealed end of the cleaner, the tube is surrounded by a solid washer that only allows water to pass through the tube and not around it. At the other end, towards the hose connection, are three braces that keep the tube centered, while allowing water to pass around the tube. This is so the water that gets backed up by the washer will spray perpendicularly outward with equal intensity to the water that passes through the tube to the bottom of the structure and then outward.

Patent or other literature are not known to the inventor which directly relate to the invention explained above.

OBJECTS

Accordingly, a principal object of the present invention is to provide a new and improved paint roller cleaner.

A further object is to provide a paint roller cleaner that uses a surge of water that is then directed perpendicularly outward through and about the nap of the roller so that it may be cleaned thoroughly.

A further object is to provide cleaning of the inner tube of the paint roller through the perpendicularly sprayed water.

Another aspect of the invention is a novel porous core paint roller.

The features of the present invention which are believed to be novel are set forth with particularity in the appended claims. The present invention, both as to its organization and manner of operation, together with further objects and advantages thereof, may be best understood by reference to the following non-limiting description, taken in conjunction with the accompanying drawings in which:

DETAILED DESCRIPTION OF PREFERRED EMBODIMENTS

Figure 1:
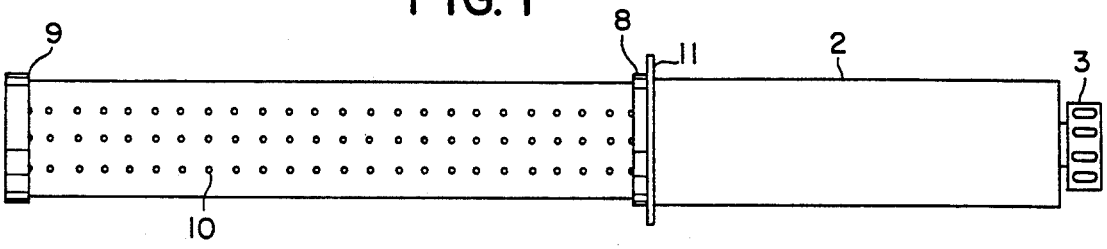
FIG. 1 is a side view of a paint roller cleaner of the invention.

FIG. 1 is a side view of a tube 2 which has an inlet port 3 that allows water to fill up the tube and exit under pressure through tiny holes 10 located at the bottom of the tube 2. A handle 11 at the top portion of the tube 2 allows for easy handling while preventing the roller from sliding past two stops 8, 9 located at the bottom and middle of the tube 2.

Figure 2:
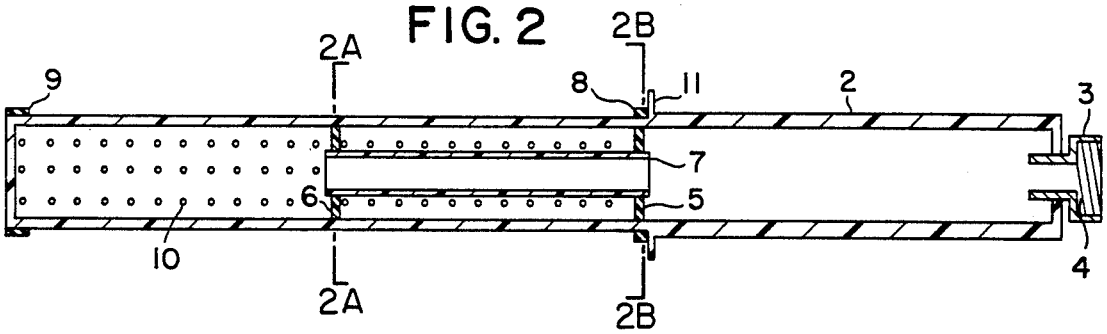
FIG. 2 is a cross section view of the paint roller cleaner of FIG. 1, which shows the inner structure of the tubes and washers that distribute the water within said paint roller cleaner.
Figure 2A:
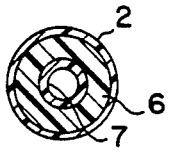
FIG 2*a* is a cross section view through A-A' of FIG. 2 showing the washer at the bottom of the inner tube that prevents the water from passing around the inner tube.
Figure 2B:
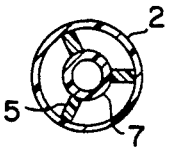
FIG. 2*b* is a cross section view through B-B' of FIG. 2 showing the supports for the inner tube that keeps said tube centered within the larger structure. The supports do not interfere with the flow of the water either through the tube or around it.

FIG. 2 is a cross section view of the tube 2 that shows in detail an inner tube 7 and washer 6 located at the bottom, and supports 5 at the top of the inner tube. It also shows the inlet port 3 and treads 4 that allow for attachment to a common garden hose.

FIG. *2a* is a cross section view of the tube 2 which shows the inner tube 7 being held in place by the solid washer 6 which does not allow water to pass around the tube 7.

FIG. *2b* is a cross section view of the tube 2 and the inner tube 7 which is held in place by the supports 5 which keep the inner tube 7 centered while allowing water to pass both through and around the inner tube 7.

Figure 3:
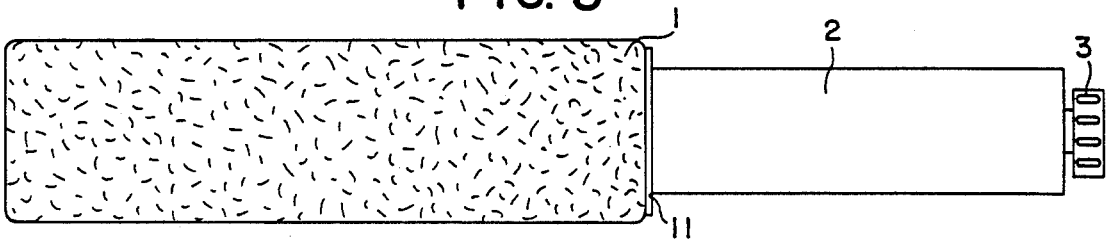
FIG. 3 is similar to FIG. 1 in that it is a side view of the paint roller cleaner but with a paint roller on it.

FIG. 3 is a side view of the tube 2 and shows the cleaner as it would look with a roller 1 on it and how the handle 11 would keep the roller in place. Also depicted is the inlet port 3 which is attachable to the standard garden hose.

Figure 4:
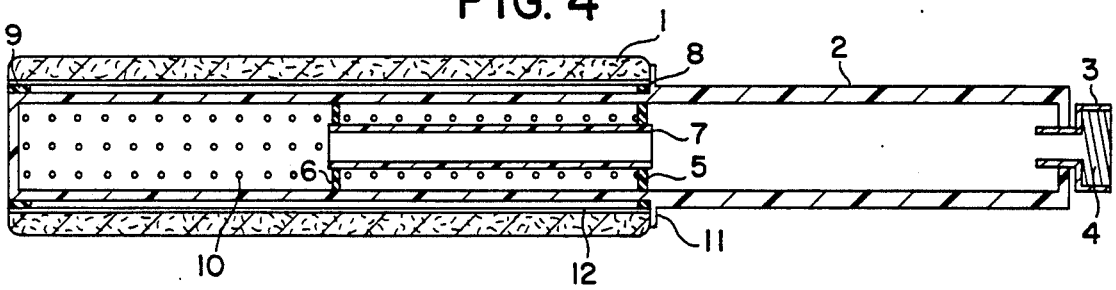
FIG. 4 is similar to FIG. 2 in that it is a cross section view of the paint roller cleaner, which shows the inner structure, only in that this figure the cross section includes the addition of a paint roller.

FIG. 4 is similar to FIG. 2 but shows the roller 1 and the rollers mesh core 12 in place on the cleaner 2. The water flows into the cleaner 2 through the inlet port 3 and down through the inner tube 7, or around it, to the bottom or to the washer 6, respectively. The water that flows around the inner tube 7, passing the braces 5 (FIG. *2b*), flows down until it gets stopped up by the washer 6 which does not allow it to pass. The backed up water is then forces perpendicularly outward through the holes 10, through the rollers mesh core 12 and through the nap of the roller 1. The water that pass through the inside of the inner tube 7 fills up the bottom half and gets backed up at the bottom of the cleaner 2 and is forced perpendicularly outward through the holes 10, then through the rollers mesh core 12 and finally through the rollers nap 13. The roller 1 is held in place by the spacer 9 at the bottom and the spacer 8 in the middle of the cleaner 2. The handle 8 also acts to hold the roller 1 in place.

Figure 5:
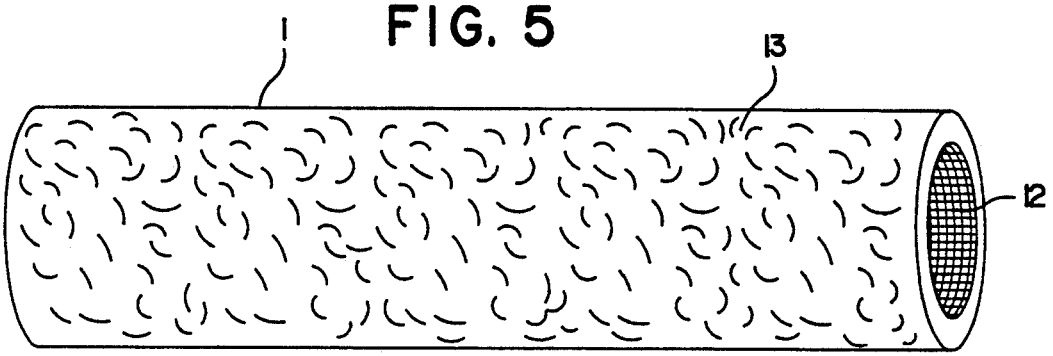
FIG. 5 is a perspective view of a paint roller that is described within this patent application.

FIG. 5 is a perspective view of the roller 1.

Figure 6:
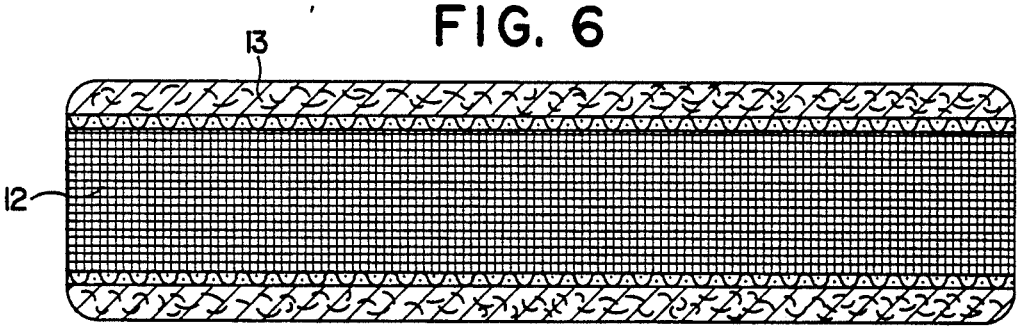
FIG. 6 is a cut away view of the paint roller showing the outer nap of the roller and the inner mesh that makes up the core of the roller.

FIG. 6 is a cut away view of the roller which shows the rollers nap 13 and the mesh core 12.

Figure 7:
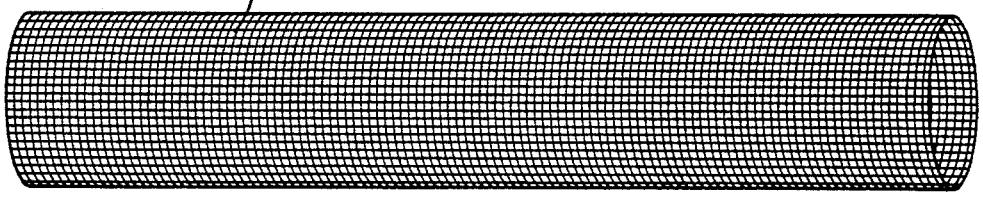
FIG. 7 is a perspective view of the mesh of the inner core of the roller.

FIG. 7 is a perspective view of the roller's 1 mesh core 12.

The bottom of the tube 2 may be closed by a plug or cap, not shown, or by a wall as shown. The cap may perform a dual function of closing the bottom end of the tube and also that of the spacer 9.

While particular pressure equalization has been achieved by the inner tube 7, pressure equalization may be obtained by adjusting the sizes and frequency of the holes 10.

While particular embodiments of the present invention have been shown and described, it will be obvious to those skilled in the art that changes and modifications may be made without departing from this invention, its broader aspects, and, therefore, the aim in the appended claims is to cover all such changes and modifications as fall within the true spirit and scope of this invention.

What is claimed is the following:

1. A paint roller cleaner comprising a tube having an outside diameter slightly smaller than an inside diameter of a roller to be cleaned and constructed to be inserted within a paint roller with a closed end and another closed end that has a threaded inlet port, said tube having outlet holes along at least part of its length, and a handle at the other end and two rings, said rings being located around the closed end and the second being abutted to the lip of the handle whereby a paint roller will be snugly mounted on the cleaner and help in place by said rings and lip of the handle.

2. A cleaner according to claim 1, wherein the threaded inlet port comprises a standard garden hose attachment for use with a garden hose.

3. A cleaner according to claim 1, further comprising an inner tube constructed to disperse the inflow of water evenly to a top half and bottom half of the paint roller cleaner.

4. A paint roller cleaner comprising a pipe; having two ends; a closure at one end; a fluid input connection at the other end; a plurality of outlet ports distributed over a surface of the pipe and extending from inside the pipe to outside the pipe; said pipe being of such a size as to receive on the outside surface thereof, over the outlet ports, a porous core paint roller, and further comprising pressure equalizer means within said tube for providing substantially equal pressure of fluid at said outlet ports, whereby when a fluid is introduced at said input connection said fluid flows into said pipe and through said outlet ports to said porous core paint roller and substrally through said paint roller thereby cleaning said paint roller with said fluid.

5. A cleaner according to claim 4 where in said pressure equalizer means comprises a inner tube co-axial with said pipe, having a top end and a bottom end, and mounted internally in said pipe; said top end being in a region of said outlet ports closest to said pipe input and said bottom end being approximately half the axial length of said pipe over which there are outlet ports; and a wall at the bottom end of said inner tube extending between said inner tube and said inside of said pipe; and an open support at said first end extending between said inner tube and said pipe inside.

6. A cleaner according to claim 5, further comprising three spacers at the top of the inner tube to keep said tube centered within the paint roller cleaner, as well as to allow water to pass around the inner tube towards the washer at the bottom of the inner tube.

7. A cleaner according to claim 6 wherein the pressure from the water inside the cleaner will provide steady jets of water through the outlet holes and through a mesh of an inner core of the roller and then through the nap of the roller, which is mounted on the cleaner and wherein no water jet will continue to squirt past the nap of the roller, but rather once the water from the jet is in the nap, gravity will take effect and pull the water down through the nap and in conjunction with the other jets, rinse the nap clean.

8. A cleaner according to claim 4 wherein said pressure means comprises an arrangement of said outlet ports of different apperature size or space of said outlet ports.

9. A cleaner according to claim 4 which further comprises a handle between said input connection and said outlet ports.

10. A cleaner according to claim 4 wherein said pipe is approximately sixteen inches long and said outlet ports extend approximately nine inches from said closed end; and wherein said outlet ports comprise eight rows of twenty-four one-sixteenth holes evenly spaced.

* * * * *